US005165137A

United States Patent [19]

Amrein et al.

[11] Patent Number: 5,165,137

[45] Date of Patent: Nov. 24, 1992

[54] HEAD SUPPORT STAND ADJUSTABLE BY COMPOUND TURNBUCKLE

[75] Inventors: Bruce E. Amrein, Bel Air; Jeffrey D. Nickel, Fallston, both of Md.

[73] Assignee: The United States of America as represented by the Secretary of the Army, Washington, D.C.

[21] Appl. No.: 902,166

[22] Filed: Jun. 22, 1992

[51] Int. Cl.[5] ..... A47C 20/04

[52] U.S. Cl. ..... 5/640; 5/638; 5/643; 403/43; 403/44

[58] Field of Search ..... 5/622, 634, 636, 638, 5/640, 643; 297/408, 409; 403/43–48

[56] References Cited

U.S. PATENT DOCUMENTS

| | | | |
|---|---|---|---|
| 310,767 | 1/1885 | Wilson | 403/44 X |
| 477,197 | 6/1892 | Barker | 297/408 X |
| 2,107,962 | 2/1938 | Sheasby | 5/640 X |
| 2,490,088 | 12/1949 | Penn | 297/408 X |
| 2,841,857 | 7/1958 | Blachly | 5/636 X |
| 4,130,269 | 12/1978 | Schreyer | 403/45 X |
| 4,504,050 | 3/1985 | Osborne | 5/640 X |

*Primary Examiner*—Michael F. Trettel

*Attorney, Agent, or Firm*—Peter A. Taucher; David L. Kuhn

[57] ABSTRACT

The invention is an improved head support stand used to smoothly and accurately position a patient's head when imaging the patient's upper spinal area. The improved stand includes a compound turnbuckle mounted between a base of the stand and a head cradle or face plate mounted to the base. The compound turnbuckle includes two rods threadingly engaged to a turnbuckle body so that the rods translate with respect to the body when it rotates. When the compound turnbuckle is in a fully retracted position, the rods are in a telescoped configuration within the turnbuckle body. When the compound turnbuckle is in a fully extended position, the rods are axially remote from each other and project substantially all the way out of the turnbuckle body.

9 Claims, 1 Drawing Sheet

HEAD SUPPORT STAND ADJUSTABLE BY COMPOUND TURNBUCKLE

GOVERNMENT USE

The invention described herein may be manufactured, used and licensed by or for the U.S. Government for governmental purposes without payment to us of any royalty.

BACKGROUND

Our invention concerns apparatuses for positioning a patient's head when imaging tissue or bones in the region of the patient's neck and spine. One method of imaging is a myelographic examination wherein a patient lies prone with his head held tilted by a head support stand. The myelographic examination requires that a contrasting or image enhancing agent be introduced in the area being examined. The introduction is done by injection through a a needle placed approximately two millimeters from the patient's spinal cord. After placement of the needle, the patient's head is repositioned until the bones of the spinal column are properly aligned for imaging. Movement of the head is accomplished via trial-and-error resetting of the head support stand. This movement, unless smooth and well controlled, can cause loss of myelogrphic test data, pain to the patient, and injury to the spinal column by the needle.

A current head support stand is disclosed in U.S. Pat. No. 4,504,050 to Osborne, wherein a repositionable face plate is mounted between two uprights. The face plate is moved after loosening knobs on the uprights near the plate's temple area or after loosening other knobs near the plate's chin area. Movement of the face plate is done by hand, whereby the accuracy and smoothness of the movement are limited.

Other head support stands are shown in U.S. Pat. Nos. 3,957,262 3,319,954 and 2,507,172. Given the dates of these references, we believe the problems with control and smoothness in head stand repositioning have remained unrecognized and unsolved for at least twenty-five years.

SUMMARY

Our invention addresses the aforementioned problems by means of a compound turnbuckle pivotally mounted between the face plate and base of a head support stand. The compound turnbuckle affords a previously unavailable smoothness and delicacy in face plate positional adjustment. The compound turnbuckle is operable by one of an operator's hands and holds the face plate in position when the operator's hand is removed.

Our turnbuckle includes a body within which threaded rods telescope or pass each other so as to maximize the turnbuckle's range of adjustment relative to its overall size. Such maximization is advantageous because of the limited space between the base and the face plate where the turnbuckle fits. The compound turnbuckle also includes a stop on one of the rods to prevent both rods from being translated completely out of the turnbuckle body.

DETAILED DESCRIPTION

Figure 1:
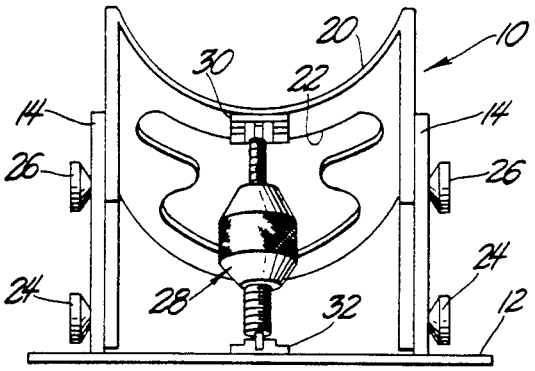
FIG. 1 is a front elevational view of a head support stand having a compound turnbuckle thereon.

FIG. 1 shows a support stand 10 used to position the head of a patient lying prone on his stomach during a medical procedure such as a myelographic examination. Support stand 10 includes base 12, side walls 14 fixed to the base, and a face plate 20 mounted to the side walls. Face plate 20 defines a specially shaped opening 22 to allow the patient's nose and other facial parts to protrude through the face plate. Knobs 24 and 26 are threadingly engaged to face plate 20 and can be moved along arcuate slots 16 and 18 and then tightened down so as to hold face plate 20 at a desired angle relative to the base. A compound turnbuckle assembly 28 is used to move face plate 20 when knobs 24 or knobs 26 are loosened. All the elements of support stand 12 and compound turnbuckle assembly 28 are made of materials transparent to X-rays.

Figure 3:
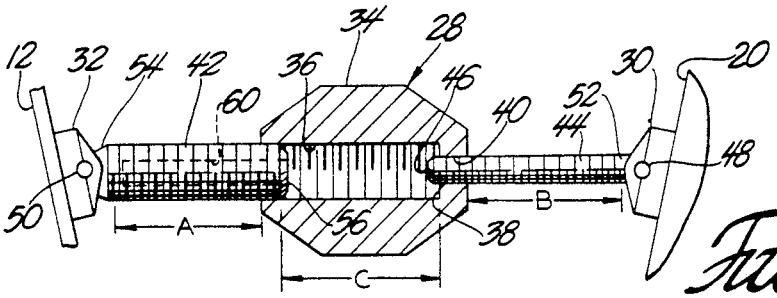
FIG. 3 is a partly sectioned view of the turnbuckle attached to the stand's base and face plate while the turnbuckle is in its fully extended position.

As best seen in FIG. 3, turnbuckle assembly 28 includes a turnbuckle body 34 defining a stepped bore. The bore has an axially longer, diametrically larger bore section 36, a shoulder 38 and an axially shorter, diametrically smaller bore section 40. Larger section 36 is threaded with outer rod 42, so that turning the turnbuckle body translates rod 42 in or out of the body when rod 42 is rotationally fixed. Similarly, smaller section 40 is threaded with inner rod 44 so that turning the turnbuckle body likewise translates rod 44. Body 34, larger bore section 36, smaller bore section 40, outer rod 42 and inner rod lie concentrically along rotational axis 62 (FIGS. 5 and 6) of the turnbuckle body.

Figure 2:
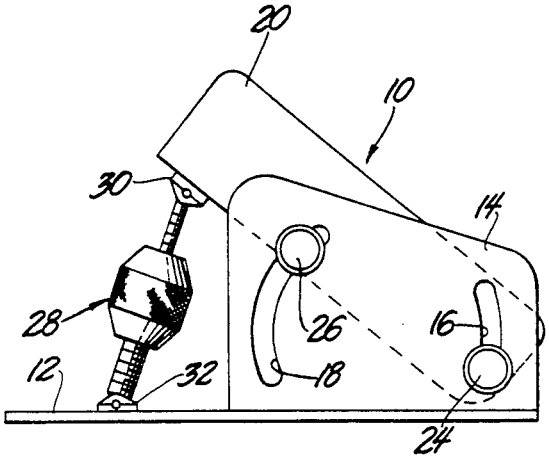
FIG. 2 is a side elevational view of the head support stand and the compound turnbuckle.

Rod 44 has a small annular shoulder or stop 46 whose diameter is larger than that of bore section 40 so that rod 44 can not be removed rightward out of body 34 as seen in FIG. 3. At terminal zone 52 located at end of rod 44 more remote from body 34 is bracket 30 pivotally connected to zone 52 by means of axis pin 48. As seen in FIGS. 1 and 2, bracket 30 is fixed to face plate 20.

Rod 42 has an elongate internal cavity open toward rod 44 and sized to receive rod 44 when the two rods translate into telescoping engagement. A terminal zone 54 is at the end of rod 42 more distal from body 34, and bracket 32 is connected to zone 54 by means of axis pin 50. As seen in FIGS. 1 and 2, bracket 32 is fixed to base 12.

The larger bore section 36 is threaded oppositely from smaller bore section 40 so that turning body 34 translates the bodies in opposite axial directions, the rods either both translating simultaneously outward or both translating simultaneously inward relative to the body. As seen in FIG. 3, stop 46 bears against shoulder 38 so as to halt rotation of turnbuckle body 34 in a direction that translates rod 44 further outward. Since internal end 56 of rod 42 remains inside body 34 when such turnbuckle rotation stops, stop 46 prevents rod 42 from escaping body 34 as well as trapping rod 44 therein.

Figure 4:
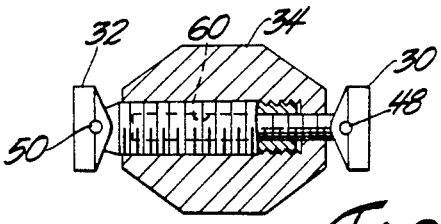
FIG. 4 is a partly sectioned view of the turnbuckle attached to the stand's base and face plate while the turnbuckle is in the fully retracted position.

Outer rod 42 has a majority of its axial length, designated as dimension "A" in FIG. 3, which is outside body 34 when turnbuckle 28 is in the fully extended position in FIG. 3 but is inside body 34 during the turnbuckle's fully retracted position shown in FIG. 4. Likewise inner rod 44 has a majority of its axial length, designated as dimension "B" in FIG. 3, which is outside body 34 when turnbuckle 28 is in the fully extended position in FIG. 3 but is inside body 34 during the turnbuckle's fully retracted position shown in FIG. 4. It is preferable that dimensions "A" and "B" be equal to each other and that they be equal to dimension "C" which is the maximum distance between internal end 56 of rod 42 and shoulder 38 in larger section 36. These preferred dimensions maximize the total axial adjustment length of compound turnbuckle 28 and thereby maximize the positional adjustability of head support stand 10.

FIG. 3 shows the minimum size of a contacting or engagement zone between rod 42 and body 34 and and likewise shows the minimum size of an engagement zone between rod 44 and body 34. It is recognized that the lengths of these zones may vary from one another, and also that the axial dimension of stop 40 and the depth of blind bore 60 may vary from one application to the next. Should these or other variances make it desirable that dimensions "A" and "B" will be only approximately equal, then it is preferred that the rods have different thread pitches, the difference in thread pitch being proportional to the difference in lengths "A" and "B," thereby maximizing the extent to which compound turnbuckle 28 can still collapse or telescope together as in FIG. 4.

The thread pitches of the rods are sized small enough so that axial force along the rods will not rotate turnbuckle body 34. The materials of body 34 and the rods, as well as tightness of fit, can increase frictional resistance so as to prevent turnbuckle body rotation due to axial force along the rods.

Figure 5:
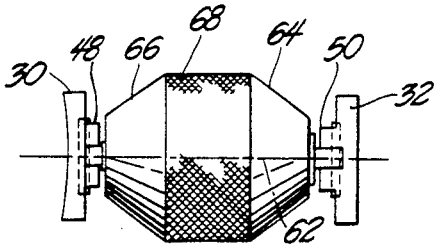
FIGS. 5 and 6 are unsectioned views of the compound turnbuckle.
Figure 6:
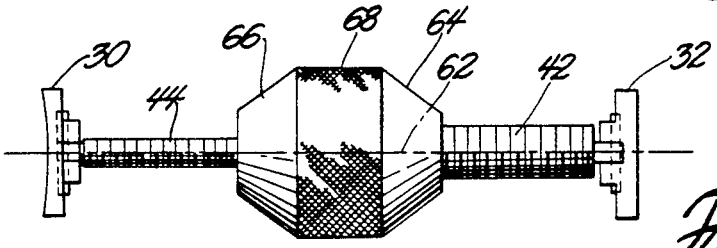

As best seen in FIGS. 5 and 6, turnbuckle body 34 is radially symmetric with respect to axis 62 and has frusto-conical ends 64 and 66 separated by a straight cylindrical intermediate portion 68. Intermediate portion 68 is knurled or textured to facilitate a good grip thereon by a human hand and, additionally, the diameter of portion 68 is sized for a such a grip. It is preferred that the diameter of intermediate portion 68 be approximately 2 inches and it is further preferred that this diameter be at least three times the outside diameter of outer rod 42. Two advantages result from the relatively larger size of the intermediate portion's diameter as compared to the outside diameters of the rods. First, it provides a mechanical advantage whereby the head support stand's position is more easily adjusted. Second, a relatively larger movement of a hand gripping turnbuckle body 34 causes a relatively smaller change in the length of compound turnbuckle 28, thereby allowing a more finely controlled adjustment of the head support stand's position.

To assemble compound turnbuckle 28, one first inserts terminal zone 52 of inner rod 44 into larger bore section 36 and then passes terminal zone 52 through small bore section 40. Inner rod 44 is then pivotally connected to face plate 20 by means of inner bracket 30 and axis pin 48, whereupon stop 46 and bracket 30 prevent the removal of rod 44 from turnbuckle body 34. Internal end of outer rod 42 is then screwed into larger bore section 36 and terminal zone 54 of rod 42 is pivotally attached to base 12 by means of bracket 50 and axis pin 50. Turnbuckle 28, base 12 and face plate 20 are so assembled that internal end 56 of outer rod 42 stays in larger bore section 36 when stop 46 bears against shoulder 38 during the fully extended position of inner rod 44.

We wish it to be understood that we do not desire to be limited to the exact details of construction shown and described herein since obvious modifications will occur to those skilled in the relevant arts without departing from the spirit and scope of the following claims.

We claim:

1. A support stand for positioning the head of a patient who is lying prone, comprising:

a base;

a face plate;

means for movably mounting the face plate to the base;

a first rod pivotally connected to the face plate;

a second rod pivotally connected to the base;

one of the rods being relatively larger in diameter and another of the rods being relatively smaller in diameter;

a turnbuckle body engaging the rods;

the one rod defining an internal bore in which the other rod is receivable;

the rods having one position wherein segments of the rods are within the turnbuckle body and portions of the segments are in telescoped juxtaposition within the turnbuckle body.

2. The device of claim 1 wherein one of the portions comprises a majority of a length of the one rod and another of the portions comprises a majority of the length of the other rod.

3. The device of claim 1 wherein:

the turnbuckle body defines a stepped bore having a larger diameter section engaging the one rod and a smaller diameter section engaging the other rod;

the device further comprises means for preventing the rods from being translated away from the body past fully extended positions, the preventing means including a stop on either the one or the other rod, wherein the stop engages the stepped bore during the fully extended position of the other rod.

4. The device of claim 3 wherein the stop is an annular enlargement at one end of the other rod, the annular enlargement engaging a shoulder in the stepped bore during the fully extended position of the other rod.

5. The device of claim 1 wherein:

the one rod has a first threaded zone that is within the turnbuckle body during a fully retracted position of the one rod and is exterior to the turnbuckle body during a fully extended position of the one rod;

the other rod has a second threaded zone that is within the turnbuckle body during a fully retracted position of the other rod and is exterior to the turnbuckle body during a fully extended position of the other rod;

the first threaded zone is equal in length to the second threaded zone.

6. The device of claim 1 wherein:

the one rod has a first threaded zone that is within the turnbuckle body during a fully retracted position of the one rod and is exterior to the turnbuckle body during a fully extended position of the one rod;

the other rod has a second threaded zone that is within the turnbuckle body during a fully retracted position of the other rod and is exterior to the turnbuckle body during a fully extended position of the other rod;

a difference in thread pitch of the rods is proportional to a difference in axial length of the rods.

7. A support stand for positioning the head of a patient who is lying prone and chest down, comprising:

a base;

upright members on the base;

a positionable face plate mounted between the upright members;

a first rod pivotally connected to the face plate;

a second rod pivotally connected to the base and rotationally fixed relative to the first rod;

one of the rods being relatively larger in diameter and another of the rods being relatively smaller in diameter;

a turnbuckle body threadingly engaging the rods;

the one rod defining an internal bore in which the other rod is coaxially receivable;

the rods having one position wherein segments of the rods are within the turnbuckle body and portions of the segments are in telescoped juxtaposition within the turnbuckle body;

the rods having a second position wherein the segments are axially remote from one another and the greater part of each rod is outside the turnbuckle body.

8. A support stand for positioning the head of a patient who is lying prone, comprising:

a base;

a face plate;

means for movably supporting the face plate on the base;

a first elongate member pivotally connected to the face plate;

a second elongate member pivotally connected to the base;

a turnbuckle body threadingly engaging the elongate members such that turning the turnbuckle body simultaneously translates both of the elongate members relative to the turnbuckle body;

the elongate members having one position wherein each of the elongate members extends more than halfway through the turnbuckle body and the elongate members engage one another within the body the elongate members having a second position wherein the elongate members are axially remote from one another and the greater part of each of the elongate members is outside the turnbuckle body.

9. The device of claim 8 further comprising means for preventing the elongate members from being translated away from the body past fully extended second positions, the preventing means including a stop on the first elongate member wherein the stop engages the turnbuckle body during the fully extended second position of one of the elongate members.

* * * * *